US009456675B1

(12) United States Patent
Haas

(10) Patent No.: US 9,456,675 B1
(45) Date of Patent: Oct. 4, 2016

(54) DEVICE FOR FACILITATING SELF PEDICURE

(71) Applicant: Joseph B. Haas, Derry, PA (US)

(72) Inventor: Joseph B. Haas, Derry, PA (US)

( * ) Notice: Subject to any disclaimer, the term of this patent is extended or adjusted under 35 U.S.C. 154(b) by 0 days.

(21) Appl. No.: 14/936,919

(22) Filed: Nov. 10, 2015

(51) Int. Cl.
*A45D 29/05* (2006.01)
*A43B 7/00* (2006.01)
*A45D 29/04* (2006.01)

(52) U.S. Cl.
CPC ..... *A45D 29/05* (2013.01); *A43B 7/00* (2013.01); *A45D 2029/045* (2013.01)

(58) Field of Classification Search
CPC ..... A43B 7/00; A43B 7/146; A43B 3/0005; A43B 3/0015; A45D 29/05; A45D 29/00; A45D 29/14; A45D 2029/045; A45D 2029/008
See application file for complete search history.

(56) References Cited

U.S. PATENT DOCUMENTS 3,905,376 A 9/1975 Johnson et al.
3,987,559 A * 10/1976 Roberts ..... A43B 7/00 36/95
4,643,207 A 2/1987 Grahame
5,870,837 A 2/1999 Poulos
6,532,969 B2 3/2003 Nuzzo
7,766,330 B2 8/2010 Balzano
7,802,381 B2 * 9/2010 Condie ..... A43B 1/0054 36/101
8,932,186 B2 1/2015 Ferri
2006/0265903 A1 11/2006 Strong
2008/0161734 A1 * 7/2008 Blockton ..... A43B 3/0005 601/70
2010/0229884 A1 * 9/2010 Alony ..... A43B 3/00 132/73.5
2015/0342288 A1 * 12/2015 Taylor ..... A43B 3/107 36/97
2015/0374094 A1 * 12/2015 Gift ..... A45D 29/22 36/94

* cited by examiner

*Primary Examiner* — Rachel Steitz
(74) *Attorney, Agent, or Firm* — Richard L. Miller

(57) ABSTRACT

Footwear worn on a foot of a user having a heel and toes with toenails, and abrades the toenails of the toes of the foot of the user without any input from the user. The footwear includes a sole, an insole, a vamp, a toe portion, and a pedicure assembly. The insole is disposed on top of the sole, and has the foot of the user rest thereon. The vamp extends upwardly from the sole, and overlies the foot of the user. The toe portion extends upwardly from the sole, forwardly from the vamp, and overlies the toes of the foot of the user. The pedicure assembly is disposed within the toe portion, and abrades the toenails of the toes of the foot of the user without any input from the user.

41 Claims, 7 Drawing Sheets

DEVICE FOR FACILITATING SELF PEDICURE

BACKGROUND OF THE INVENTION

1. Field of the Invention

The present invention relates to a pedicure device, and more particularly, a device for facilitating self-pedicure.

2. Description of the Prior Art

Numerous innovations for foot-manipulating devices have been provided in the prior art that will be described. Even though these innovations may be suitable for the specific individual purposes to which they address, however, they differ from the present invention.

A FIRST EXAMPLE, U.S. Pat. No. 3,905,376, Published/Issued on Sep. 16, 1975, to Johnson, et al. teaches a support for the metatarsal arch of the foot, which is formed by injection of a self-curing, non-foamable, and fluid material into the arch support enclosure. This fluid material automatically cures into a rigid support or prosthesis for the arch of the foot. This polymerizable material is normally contained in either an insert under the foot or by a balloon-like material. In either case, the polymerizable material is pumped or injected into the resulting enclosure. The same method can be used to form in situ prosthesis casts for any part of the body, i.e., to form splints, braces, etc., that are contoured directly to the portion of the human body for which it is designed to lend support. The self-curing material is, preferably, a cross-linkable prepolymerized material that includes an initiator. The self-curing is achieved by the application of mild temperatures, i.e., not greater than 120° F. Also, the self-curing can be achieved by the application of actinic radiation.

A SECOND EXAMPLE, U.S. Pat. No. 4,643,207, Published/Issued on Feb. 17, 1987, to Grahame teaches a cuticle manicuring device, wherein a vibrating electrical motor is contained within an elongated and pencil shaped housing, and wherein a manicuring implement extends axially from one end of the housing. The manicuring implement includes a vibrating stem driven by the vibrating motor and having a crescent-shaped abrasive element that is disposed at the distal end thereof. A cuticle guide extends from the end of the housing parallel to the vibrating stem and is broad enough to provide support to the oscillating abrasive element. The tip of the guide is formed as a point and extends beyond the abrasive element so as to enter beneath the cuticle and provide a limit stop to the forward movement of the abrasive element. A cap fits over the manicuring implement to frictionally engage with the housing to be retained thereon. A retractable cuticle lifter is in the cover.

A THIRD EXAMPLE, U.S. Pat. No. 5,870,837, Published/Issued on Feb. 16, 1999, to Poulos teaches a pedicure sandal combination footwear that provides a toe divider that is releasably secured to a sandal so as to maintain the toes in a predetermined position. The sandal includes a bridge strap that opens to allow the vertical placement of a foot onto the base member by use of the hook and pile attachment, thereby allowing an individual to first position the toe divider onto the foot before placement of the foot onto the sandal. Once the foot is properly positioned, the bridge straps may be wrapped around the foot so as to secure the foot in a fixed position.

A FOURTH EXAMPLE, U.S. Pat. No. 6,532,969, Published/Issued on Mar. 18, 2003, to Nuzzo teaches a compact and portable self-pedicure unit for use in performing self-pedicures. The self-pedicure unit includes an adjustable foot support and at least one product storage compartment. The adjustable foot support provides for positioning of the foot at an angle optimal for comfort, support, and pedicure results. The product storage compartment(s) provide the user of the self-pedicure unit with easy access to, and retrieval of, pedicure related supplies during performance of a self-pedicure. The product storage compartment(s) further provide for storage of pedicure related products when the unit is not in use.

A FIFTH EXAMPLE, U.S. Pat. No. 7,766,330, Published/Issued on Aug. 3, 2010, to Balzano teaches a device for relaxing a participant while participating in an activity. The device may include an amusement machine and a relaxasizer. The amusement machine may be interactive with the participant. Also, the amusement machine may have a receptacle with a starter circuit for permitting the participant to interact with the amusement machine. The relaxasizer may be positioned adjacent to the amusement machine for massaging the participant's lower body while the participant interacts with the machine. Also, the relaxasizer may be activated by the starter circuit of the amusement machine.

A SIXTH EXAMPLE, U.S. Pat. No. 8,932,186, Published/Issued on Jan. 13, 2015, to Ferri teaches an exercise tool. More particularly, it is a therapy and exercise tool specifically devised as a foot-therapy and toe-aligning device to align, separate, and stretch toes. The foot-therapy and toe-aligning device includes a frame with a plurality of posts connected with the frame. The device is formed of an elastic material so that a user may place at least one of the plurality of posts between a user's toes and pull the post to stretch and elongate the post between the toes. Upon release, the elastic material of the post causes the post to attempt to return to its original shape, thereby causing it to expand out and conform its shape to fit snugly against the user's toes. Additionally, the elastic material allows the toe posts to be positioned and maintained at numerous locations between the user's toes for customizable positioning between the toes.

A SEVENTH EXAMPLE, U.S. Patent Office Document No. 2006/0265903, Published/Issued on Nov. 30, 2006, to Strong teaches a cushioned foot pad configured to adhere to the bottom surface of an individual's foot without the use of straps, ties, or other securing devices the might otherwise engage with the toes and toenails of the individual during use. The cushioned foot pad may be configured to accommodate a variety of different foot shapes and sizes in a unitary design through the use of detachable pad portions.

It is apparent now that numerous innovations for foot-manipulating devices have been provided in the prior art that adequate for various purposes. Furthermore, even though these innovations may be suitable for the specific individual purposes to which they address, accordingly, they would not be suitable for the purposes of the present invention as heretofore described.

SUMMARY OF THE INVENTION

AN OBJECT of the present invention is to provide a device for facilitating self-pedicure that avoids the disadvantages of the prior art.

ANOTHER OBJECT of the present invention is to provide a device for facilitating self-pedicure that is simple and inexpensive to manufacture.

STILL ANOTHER OBJECT of the present invention is to provide a device for facilitating self-pedicure that is simple to use.

BRIEFLY STATED, STILL YET ANOTHER OBJECT of the present invention is to provide footwear worn on a foot of a user having a heel and toes with toenails, and abrades the toenails of the toes of the foot of the user without any input from the user. The footwear includes a sole, an insole, a vamp, a toe portion, and a pedicure assembly. The insole is disposed on top of the sole, and has the foot of the user rest thereon. The vamp extends upwardly from the sole, and overlies the foot of the user. The toe portion extends upwardly from the sole, forwardly from the vamp, and overlies the toes of the foot of the user. The pedicure assembly is disposed within the toe portion, and abrades the toenails of the toes of the foot of the user without any input from the user.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawings are briefly described as follows.

A MARSHALING OF REFERENCE NUMERALS UTILIZED IN THE DRAWING

Introductory

Figure 1:
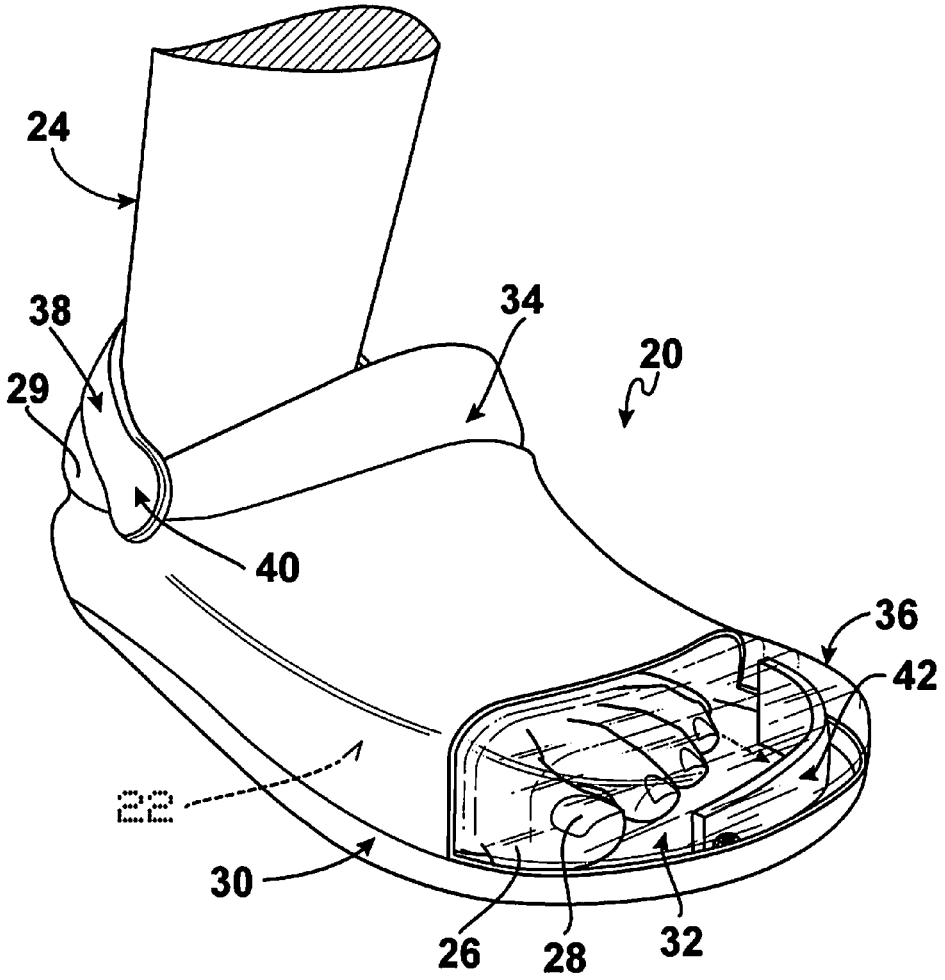
FIG. 1 is a diagrammatic perspective view illustrating an embodiment of the invention donned on a user's left foot.

20 footwear of embodiments of present invention for wearing on foot 22 of user 24 having toes 26 with toenails 28 and heel 29, and for abrading toenails 28 of toes 26 of foot 22 of user 24 without any input from user 24
22 foot of user 24
24 user
26 toes of foot 22 of user 24
28 toenails of toes 26 of foot 22 of user 24
29 heel of foot 22 of user 24

Overall Configuration of Footwear 20

30 sole
32 insole for having foot 22 of user 24 rest thereon
34 vamp for overlying foot 22 of user 24
36 toe portion for overlying toes 26 of foot 22 of user 24
38 strap for engaging heel 29 of foot 22 of user 24
40 fastener
42 pedicure assembly for abrading toenails 28 of toes 26 of foot 22 of user 24 without any input from user 24

Specific Configuration of Pedicure Assembly 42

44 base plate of pedicure assembly 42
46 abrasive pad strip of pedicure assembly 42 for abrading toenails 28 of toes 26 of foot 22 of user 24 without any input from user 24
48 one of hook and loop pile fastener backing of pedicure assembly 42
50 other of hook and loop pile fastener strip 50 of pedicure assembly 42
52 operating subassembly of pedicure assembly 42

Specific Configuration of Operating Subassembly 52 of Pedicure Assembly 42

54 battery-operated vibrator of operating subassembly 52 of pedicure assembly 42
56 battery interface of operating subassembly 52 of pedicure assembly 42 for holding batteries 60 for powering battery-operated vibrator 54 of operating subassembly 52 of pedicure assembly 42
58 accessible compartment of sole 30
60 batteries for powering battery-operated vibrator 54 of operating subassembly 52 of pedicure assembly 42
62 pressure-sensitive sensor of operating subassembly 52 of pedicure assembly 42 for closing when foot 24 of user 22 steps thereon
64 control unit of operating subassembly 52 of pedicure assembly 42

DETAILED DESCRIPTION OF THE PREFERRED EMBODIMENT

Introductory

Figure 2:
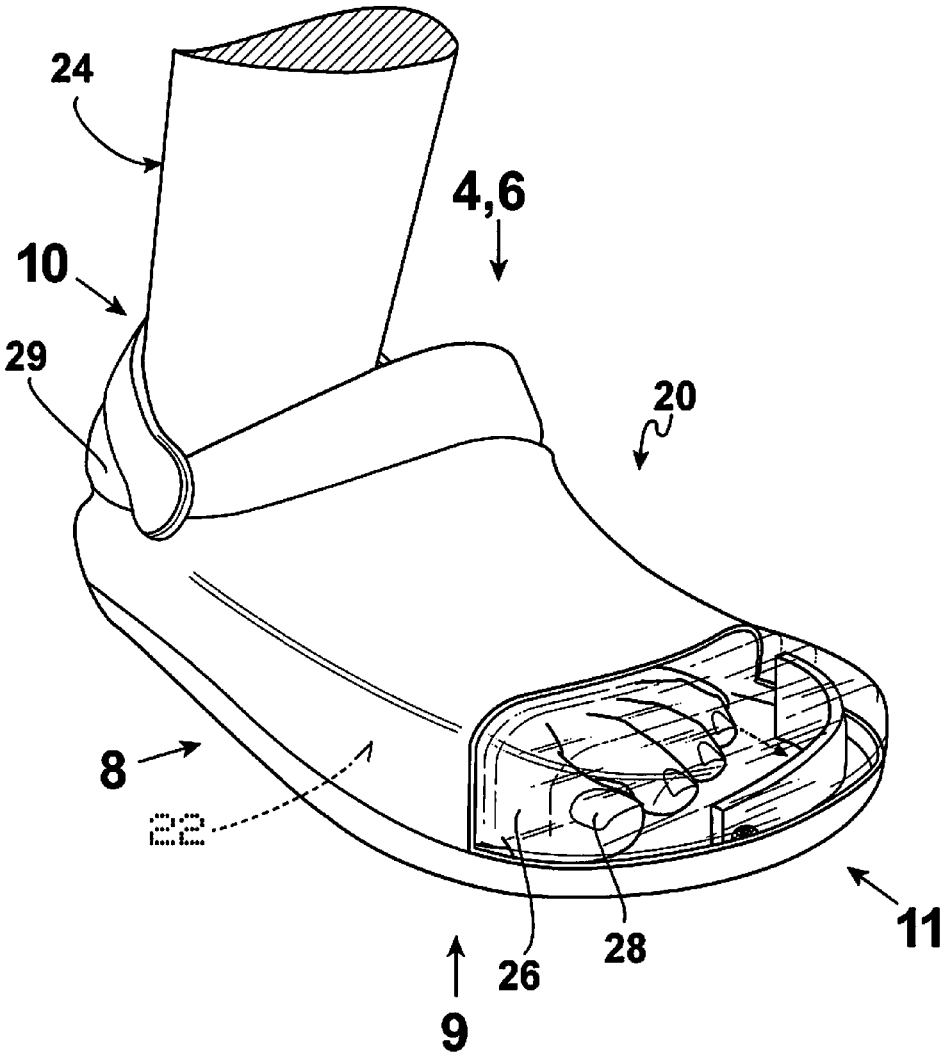
FIG. 2 is a diagrammatic perspective view illustrating an embodiment of the invention per se.
Figure 3:
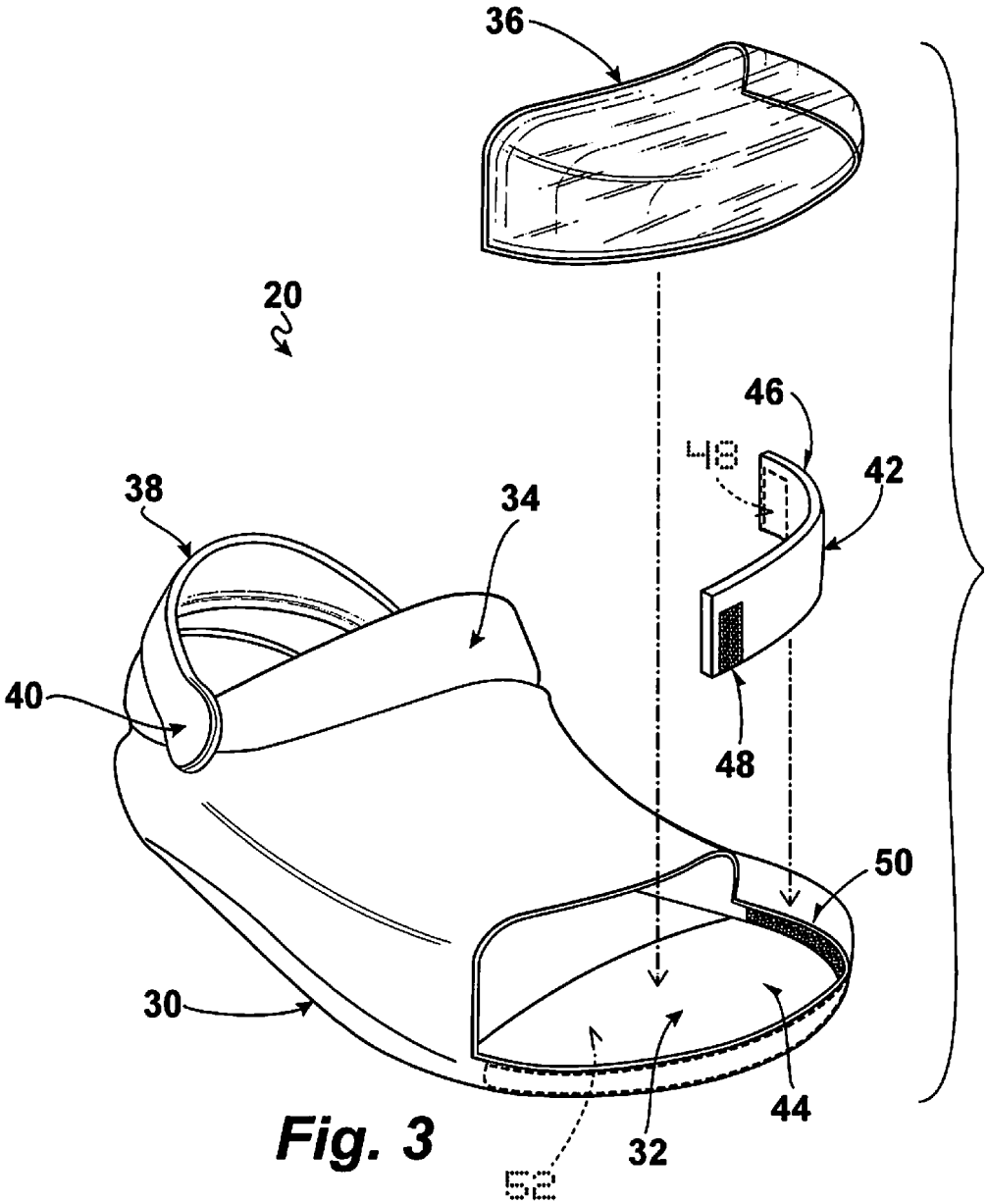
FIG. 3 is a diagrammatic perspective view illustrating an embodiment of the invention with parts exploded therefrom.
Figure 4:
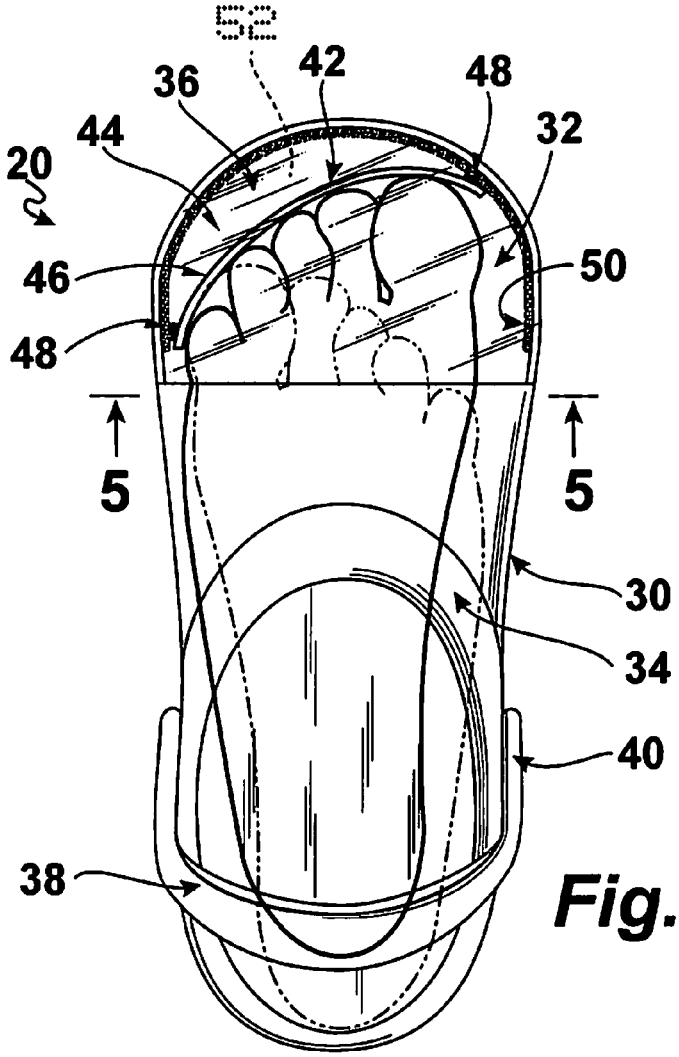
FIG. 4 is a top plan view thereof taken in the direction of arrow 4,6 in FIG. 2, showing a left baby toe being pedicured in solid lines and a right big toe being pedicured in phantom lines.
Figure 5:
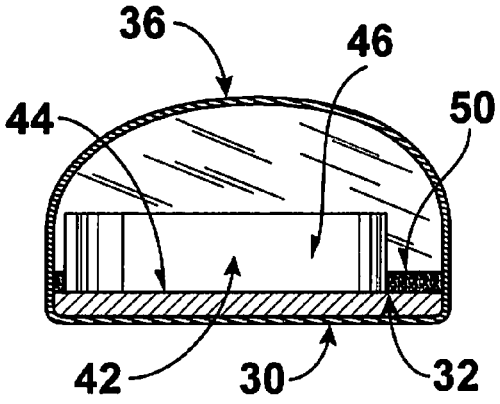
FIG. 5 is a diagrammatic cross sectional view taken on line 5-5 in FIG. 4.
Figure 6:
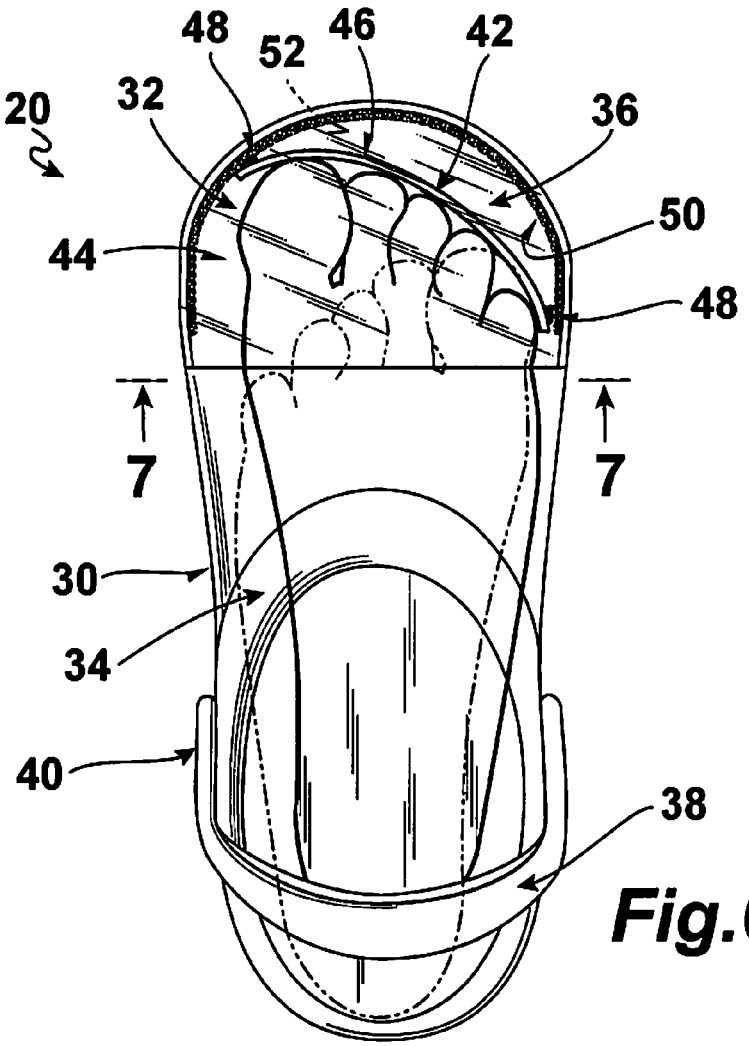
FIG. 6 is a top plan view thereof taken in the direction of arrow 4,6 in FIG. 2, showing a right baby toe being pedicured in solid lines and a left big toe being pedicured in phantom lines.
Figure 7:
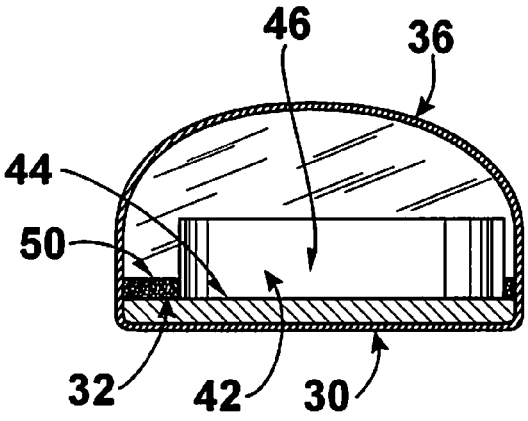
FIG. 7 is a diagrammatic cross sectional view taken on line 7-7 in FIG. 6.
Figure 8:
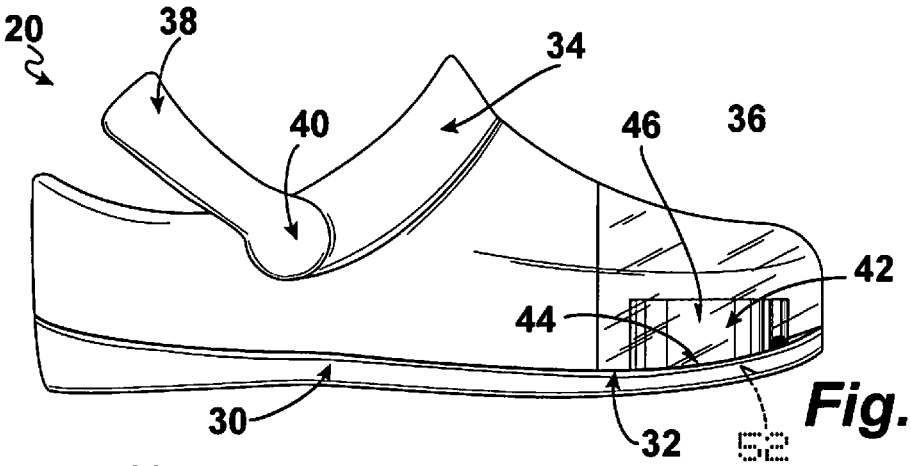
FIG. 8 is a side elevational view taken in the direction of arrow 8 in FIG. 2.

Referring now to the figures, in which like numerals indicate like parts, and particularly to FIGS. 1 and 2, the footwear of the embodiments of the present invention is shown generally at 20 for wearing on a foot 22 of a user 24 having a heel 29 and toes 26 with toenails 28, and for abrading the toenails 28 of the toes 26 of the foot 22 of the user 24 without any input from the user 24.

Overall Configuration of the Footwear 20 and the Specific Configuration of the Pedicure Assembly 42

The overall configuration of the footwear 20 and the specific configuration of the pedicure assembly 42 can best be seen in FIGS. 3-8, 10, and 11, and as such, will be discussed with reference thereto.

Overall Configuration of the Footwear 20

The footwear 20 comprises a sole 30, an insole 32, a vamp 34, a toe portion 36, and a pedicure assembly 42. The insole 32 is disposed on top of the sole 30, and is for having the foot 22 of the user 24 rest thereon. The vamp 34 extends upwardly from the sole 30, and is for overlying the foot 22 of the user 24. The toe portion 36 extends upwardly from the sole 30, extends forwardly from the vamp 34, and is for overlying the toes 26 of the foot 22 of the user 24. The pedicure assembly 42 is disposed within the toe portion 36, and is for abrading the toenails 28 of the toes 26 of the foot 22 of the user 24 without any input from the user 24.

The footwear 20 further comprises a strap 38.

The strap 38 extends rearwardly from the vamp 34, and is for engaging the heel 29 of the foot 22 of the user 24.

The footwear 20 further comprises a fastener 40.

The fastener 40 replaceably attaches the strap 38 to the vamp 34.

The toe portion 36 is made of transparent plastic for allowing the user 24 to view the abrading of the toenails 28 of the toes 26 of the foot 22 of the user 24 without any input from the user 24.

The toe portion 36 is replaceable to allow servicing of the pedicure assembly 42.

Specific Configuration of the Pedicure Assembly 42

The pedicure assembly 42 comprises a base plate 44.

The base plate 44 of the pedicure assembly 42 is contained within the toe portion 36, and movably overlies the insole 32.

The pedicure assembly 42 further comprises an abrasive pad strip 46.

The abrasive pad strip 46 of the pedicure assembly 42 is contained within the toe portion 36, extends upwardly from, is removably attached to, and moves with, the base plate 44 of the pedicure assembly 42 for abrading the toenails 28 of the toes 26 of the foot 22 of the user 24 without any input from the user 24.

The abrasive pad strip 46 of the pedicure assembly 42 is curved for matching contour of the toes 26 of the foot 22 of the user 24 so as to allow for abrading the toenails 28 of the toes 26 of the foot 22 of the user 24 without any input from the user 24.

The abrasive pad strip 46 of the pedicure assembly 42 is reversible, i.e., is turnable up-side-down, for accounting for the different arc path defined by the tips of the toes 26 of the left and right foot 22 of the user 24.

The abrasive pad strip 46 of the pedicure assembly 42 is flexible, and is either a soft grit, a medium grit, or a coarse grit.

The pedicure assembly 42 further comprises one of a hook and a loop pile fastener backing 48.

The one of the hook and the loop pile fastener backing 48 of the pedicure assembly 42 backs the abrasive pad strip 46 of the pedicure assembly 42.

The pedicure assembly 42 further comprises the other of a hook and a loop pile fastener strip 50.

The other of the hook and the loop pile fastener strip 50 of the pedicure assembly 42 extends upwardly from, and moves with, the base plate 44 of the pedicure assembly 42, and allows the one of the hook and the loop pile fastener backing 48 of the pedicure assembly 42 to be removably attached thereto so as to allow the abrasive pad strip 46 of the pedicure assembly 42 to be replaced when worn out or reversed when changing the foot 22 of the user 24 being abraded.

The pedicure assembly 42 further comprises an operating subassembly 52.

The operating subassembly 52 of the pedicure assembly 42 is operatively connected to the base plate 44 of the pedicure assembly 42.

Specific Configuration of the Operating Subassembly 52 of the Pedicure Assembly 42

Figure 9:
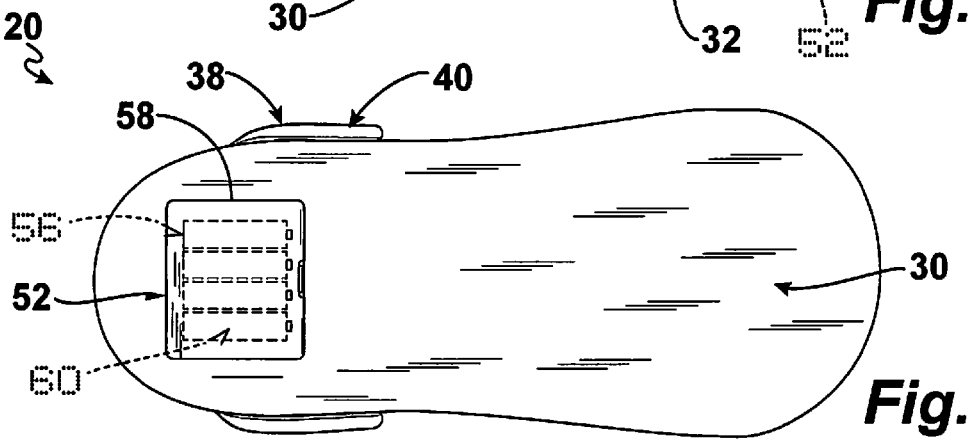
FIG. 9 is a bottom plan view thereof taken in the direction of arrow 9 in FIG. 2.
Figure 10:
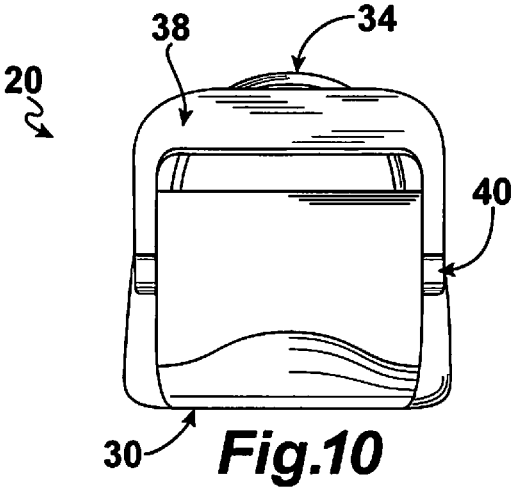
FIG. 10 is a rear elevational view taken in the direction of arrow 10 in FIG. 2.
Figure 11:
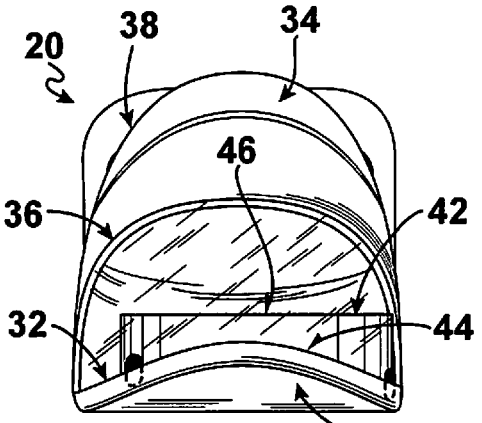
FIG. 11 is a front elevational view taken in the direction of arrow 11 in FIG. 2.
Figure 12:
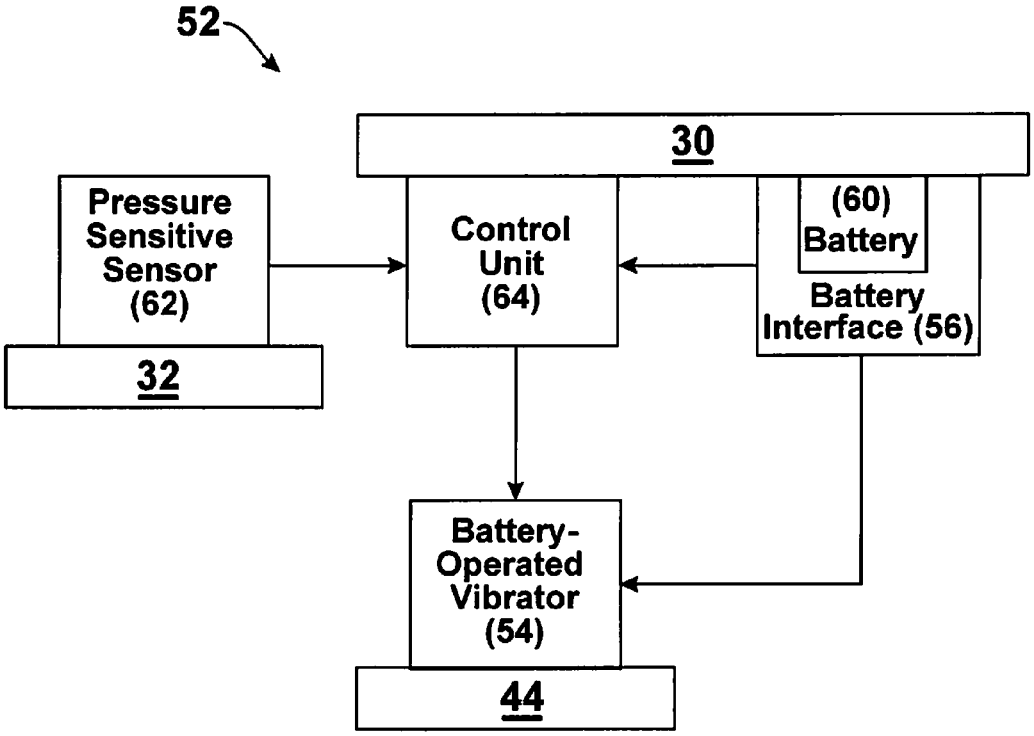
FIG. 12 is a block diagram of the electro-mechanical mechanism housed within the device.

The specific configuration of the operating subassembly 52 of the pedicure assembly 42 can best be seen in FIGS. 9 and 12, and as such, will be discussed with reference thereto.

The operating subassembly 52 of the pedicure assembly 42 comprises a battery-operated vibrator 54.

The battery-operated vibrator 54 of the operating subassembly 52 of the pedicure assembly 42 is operatively connected to the base plate 44 of the pedicure assembly 42, and selectively causes the base plate 44 of the pedicure assembly 42 to vibrate, which in turn causes the abrasive pad strip 46 of the pedicure assembly 42 to vibrate for abrading the toenails 28 of the toes 26 of the foot 22 of the user 24.

The operating subassembly 52 of the pedicure assembly 42 further comprises a battery interface 56.

The battery interface 56 of the operating subassembly 52 of the pedicure assembly 42 is disposed in an accessible compartment 58 in the sole 30, is in electrical communication with the battery-operated vibrator 54 of the operating subassembly 52 of the pedicure assembly 42, and is for holding batteries 60 for powering the battery-operated vibrator 54 of the operating subassembly 52 of the pedicure assembly 42.

The operating subassembly 52 of the pedicure assembly 42 further comprises a pressure-sensitive sensor 62.

The pressure-sensitive sensor 62 of the operating subassembly 52 of the pedicure assembly 42 is disposed on the insole 32, is in electrical communication with, and between, the battery interface 56 of the operating subassembly 52 of the pedicure assembly 42 and the battery-operated vibrator 54 of the operating subassembly 52 of the pedicure assembly 42, and is for closing when the foot 22 of the user 24 steps thereon, and in doing so, activates the battery-operated vibrator 54 of the operating subassembly 52 of the pedicure assembly 42.

The pressure-sensitive sensor 62 of the operating subassembly 52 of the pedicure assembly 42 is of varying output so the greater the pressure from the foot 22 of the user 24, the faster the battery-operated vibrator 54 of the operating subassembly 52 of the pedicure assembly 42 vibrates.

The operating subassembly 52 of the pedicure assembly 42 further comprises a control unit 64.

The control unit 64 of the operating subassembly 52 of the pedicure assembly 42 is disposed in the sole 30, and controls the operating subassembly 52 of the pedicure assembly 42.

Impressions

It will be understood that each of the elements described above, or two or more together, may also find a useful application in other types of constructions differing from the types described above.

While the invention has been illustrated and described as embodiments of a device for facilitating self pedicure, accordingly it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. Footwear for wearing on a foot of a user having a heel and toes with toenails, and for abrading the toenails of the toes of the foot of the user without any input from the user, comprising:

a) a sole;

b) an insole;

c) a vamp;

d) a toe portion; and e) a pedicure assembly;

wherein said insole is disposed on top of said sole;

wherein said insole is for having the foot of the user rest thereon;

wherein said vamp extends upwardly from said sole;

wherein said vamp is for overlying the foot of the user;

wherein said toe portion extends upwardly from said sole;

wherein said toe portion extends forwardly from said vamp;

wherein said toe portion is for overlying the toes of the foot of the user;

wherein said pedicure assembly is disposed within said toe portion;

wherein said pedicure assembly is for abrading the toenails of the toes of the foot of the user without the any input from the user;

wherein said pedicure assembly comprises a base plate;

wherein said base plate of said pedicure assembly movably overlies said insole; and wherein said pedicure assembly comprises one of a hook and a loop pile fastener backing.

2. The footwear of claim 1, further comprising a strap; and wherein said strap is for engaging the heel of the foot of the user.

3. The footwear of claim 2, further comprising a fastener.

4. The footwear of claim 3, wherein said fastener replaceably attaches said strap to said vamp.

5. The footwear of claim 1, wherein said strap extends rearwardly from said vamp.

6. The footwear of claim 1, wherein said toe portion is made of transparent plastic for allowing the user to view the abrading of the toenails of the toes of the foot of the user without the any input from the user.

7. The footwear of claim 1, wherein said toe portion is replaceable to allow servicing of said pedicure assembly.

8. The footwear of claim 1, wherein said base plate of said pedicure assembly is contained within said toe portion.

9. The footwear of claim 1, wherein said base plate of said pedicure assembly overlies said insole.

10. The footwear of claim 1, wherein said base plate of said pedicure assembly movably overlies said insole.

11. The footwear of claim 1, wherein said abrasive pad strip of said pedicure assembly is contained within said toe portion.

12. The footwear of claim 1, wherein said abrasive pad strip of said pedicure assembly extends upwardly from said base plate of said pedicure assembly.

13. The footwear of claim 1, wherein said abrasive pad strip of said pedicure assembly is removably attached to said base plate of said pedicure assembly.

14. The footwear of claim 1, wherein said abrasive pad strip of said pedicure assembly moves with said base plate of said pedicure assembly.

15. The footwear of claim 1, wherein said abrasive pad strip of said pedicure assembly is curved for matching contour of the toes of the foot of the user so as to allow for abrading the toenails of the toes of the foot of the user without the any input from the user.

16. The footwear of claim 1, wherein said abrasive pad strip of said pedicure assembly is reversible/turnable upside-down, for accounting for the different arc path defined by the tips of the toes of the left and right foot of the user.

17. The footwear of claim 1, wherein said abrasive pad strip of said pedicure assembly is flexible.

18. The footwear of claim 1, wherein said abrasive pad strip of said pedicure assembly is a soft grit.

19. The footwear of claim 1, wherein said abrasive pad strip of said pedicure assembly is a medium grit.

20. The footwear of claim 1, wherein said abrasive pad strip of said pedicure assembly is a coarse grit.

21. The footwear of claim 1, wherein said one of said hook and said loop pile fastener backing of said pedicure assembly backs said abrasive pad strip of said pedicure assembly.

22. The footwear of claim 1, wherein said pedicure assembly comprises the other of a hook and a loop pile fastener strip.

23. The footwear of claim 22, wherein said other of said hook and said loop pile fastener strip of said pedicure assembly extends upwardly from said base plate of said pedicure assembly.

24. The footwear of claim 22, wherein said other of said hook and said loop pile fastener strip of said pedicure assembly allows said one of said hook and said loop pile fastener backing of said pedicure assembly to be removably attached thereto so as to allow said abrasive pad strip of said pedicure assembly to be replaced when worn out or reversed when changing the foot of the user being abraded.

25. The footwear of claim 1, wherein said one of said hook and said loop pile fastener strip of said pedicure assembly moves with said base plate of said pedicure assembly.

26. The footwear of claim 1, wherein said pedicure assembly comprises an operating subassembly.

27. The footwear of claim 26, wherein said operating subassembly of said pedicure assembly is operatively connected to said base plate of said pedicure assembly.

28. The footwear of claim 26, wherein said operating subassembly of said pedicure assembly comprises a control unit.

29. The footwear of claim 28, wherein said control unit of said operating subassembly of said pedicure assembly is disposed in said sole.

30. The footwear of claim 28, wherein said control unit of said operating subassembly of said pedicure assembly controls said operating subassembly of said pedicure assembly.

31. The footwear of claim 26, wherein said operating subassembly of said pedicure assembly comprises a battery-operated vibrator.

32. The footwear of claim 31, wherein said battery-operated vibrator of said operating subassembly of said pedicure assembly is operatively connected to said base plate of said pedicure assembly.

33. The footwear of claim 31, wherein said battery-operated vibrator of said operating subassembly of said pedicure assembly causes said base plate of said pedicure assembly to vibrate which in turn causes said abrasive pad strip of said pedicure assembly to vibrate for abrading the toenails of the toes of the foot of the user.

34. The footwear of claim 31, wherein said operating subassembly of said pedicure assembly comprises a battery interface; and wherein said battery interface of said operating subassembly of said pedicure assembly is for holding batteries for powering said battery-operated vibrator of said operating subassembly of said pedicure assembly.

35. The footwear of claim 34, wherein said battery interface of said operating subassembly of said pedicure assembly is disposed in an accessible compartment in said sole.

36. The footwear of claim 34, wherein said battery interface of said operating subassembly of said pedicure assembly is in electrical communication with said battery-operated vibrator of said operating subassembly of said pedicure assembly.

37. The footwear of claim 34, wherein said operating subassembly of said pedicure assembly comprises a pressure-sensitive sensor; and wherein said pressure-sensitive sensor of said operating subassembly of said pedicure assembly is for closing when the foot of the user steps thereon, and in doing so, activates said battery-operated vibrator of said operating subassembly of said pedicure assembly.

38. The footwear of claim 37, wherein said pressure-sensitive sensor of said operating subassembly of said pedicure assembly is disposed on said insole.

39. The footwear of claim 37, wherein said pressure-sensitive sensor of said operating subassembly of said pedicure assembly is in electrical communication with said battery interface of said operating subassembly of said pedicure assembly and said battery-operated vibrator of said operating subassembly of said pedicure assembly.

40. The footwear of claim 37, wherein said pressure-sensitive sensor of said operating subassembly of said pedicure assembly is in electrical communication between said battery interface of said operating subassembly of said pedicure assembly and said battery-operated vibrator of said operating subassembly of said pedicure assembly.

41. The footwear of claim 37, wherein said pressure-sensitive sensor of said operating subassembly of said pedicure assembly is of varying output so the greater the pressure from the foot of the user, the faster said battery-operated vibrator of said operating subassembly of said pedicure assembly vibrates.

* * * * *